US006469958B1

(12) United States Patent
Bray

(10) Patent No.: US 6,469,958 B1
(45) Date of Patent: Oct. 22, 2002

(54) CALENDAR CURRENT DAY INDICATOR

(76) Inventor: Eugene V. Bray, 5609 Lansing Dr., Camp Springs, MD (US) 20748

( * ) Notice: Subject to any disclaimer, the term of this patent is extended or adjusted under 35 U.S.C. 154(b) by 20 days.

(21) Appl. No.: 09/635,566

(22) Filed: Aug. 10, 2000

(51) Int. Cl.[7] ..... G04B 19/24; G08B 17/00; G08B 17/04

(52) U.S. Cl. ..... 368/28; 116/107

(58) Field of Search ..... 368/28, 29, 223; 40/107, 116–118, 119–122

(56) References Cited

U.S. PATENT DOCUMENTS 3,810,322 A * 5/1974 Ritchie ..... 40/107
4,152,768 A * 5/1979 Kuriya ..... 364/705
4,205,516 A * 6/1980 Terao ..... 368/29
4,254,486 A * 3/1981 Masuda et al. ..... 368/29
4,708,490 A * 11/1987 Arber ..... 368/28

* cited by examiner

*Primary Examiner*—Vit Miska
(74) *Attorney, Agent, or Firm*—Robert Halper

(57) ABSTRACT

An automatic electrical device having a rack superimposed on an ordinary calendars and having seven light emitting diodes (LED's) of a single color affixed thereon to indicate the current day of the week, and similarly thirty-seven LED's of a single different color to indicate the current day of the month. Operation of the device is based on an electrical impulse transmitted daily by a clock through a switching network to sequentially energize the LED's. A monthly programmed electrical impulse counter provides means for coordinating operation of the device with calendar changes in a new month. Means provided to adjust leap year variation which provides means to program continuous operation of the device in unlimited time.

1 Claim, 2 Drawing Sheets

CALENDAR CURRENT DAY INDICATOR

BACKGROUND

This new invention is relevant to the automatic calendars that indicate the current day of the month. My search has found the new invention is seemingly most relevant to the following inventions.

U.S. Pat. No. 3,276,198 issued to R. A. Barbera, Oct. 4, 1966, shows an automatic calendar device that indicates the current day of the month placed behind a translucent single month sheet. This calendar must be reset each month.

A similar system is shown in U.S. Pat. No. 3,810,322 issued to E. R. Richie, May 14, 1974, showing an automatic calendar device with light placed behind a transparent web scroll to indicate the current day of the month. This calendar must be reset every four years.

U.S. Pat. No. 4,630,934 issued Dec. 23, 1986, to A. Aber shows LED's directly emitting light through apertures on a paper month sheet or light behind a transparent sheet to indicate the current day of the month. The calendar sheet is replaced each month. The device may be programmed until 2010.

W. M. Brobeck in U.S. Pat. No. 5,261,173 issued Nov. 16, 1993, shows a double scroll wall type calendar with a mechanical frame intermittently driven by electrical means across the weeks on the calendar to indicate the current day of the month without lighting. The device may be programmed until all months on the scroll have expired.

In these cited inventions, all provide means for indicating the current day of the month but none of the inventions provide a special means for indicating the current day of the week. All these devices require their own special calendars that could be difficult and costly to replace. All these inventions, in time, require resetting and/or replacement of calendar scrolls. None of the cited inventions provide the scope of particular advantages provided by the ordinary wall calendar.

SUMMARY

It can be difficult and confusing without a reference to determine the date on a calendar. The new invention provides a means whereby the viewer with a momentary glance at an ordinary calendar can quickly determine the current day of the week and the current day of the month.

The device comprises a rack to be superimposed on an ordinary calendar and with seven LED's of a single color to indicate the current day of the week and thirty-seven LED's of a single different color to indicate the current day of the month.

My study has found a portion of the population has a preference for first knowing the day of the week. The other portion of the population has a preference for first knowing the day of the month. The heretofore said the two different indicating colors provide a quick and direct way of ascertaining the current day of the week or the current day of the month.

The device coupled with an ordinary wall calendar provides the advantages of the calendar standing alone, including convenience and generally other information, art, advertising. The low cost of manufacturing in digital form makes the device cost-effective for free give-away advertising. The device may be programmed to operate continuously in unlimited time.

The controlling electrical system includes a clock that daily generates an electrical impulse to activate a network of switches to timely energize the indicating LED's. A programmed electrical impulse counter generates an electrical impulse on the first day of each month to keep the device coordinated with the changed design of the new calendar month. A programmed electrical impulse counter generates an electrical impulse on February 28, Leap Year, to provide adjustment for Leap Year variation.

DESCRIPTION OF THE PREFERRED EMBODIMENT

Figure 2:
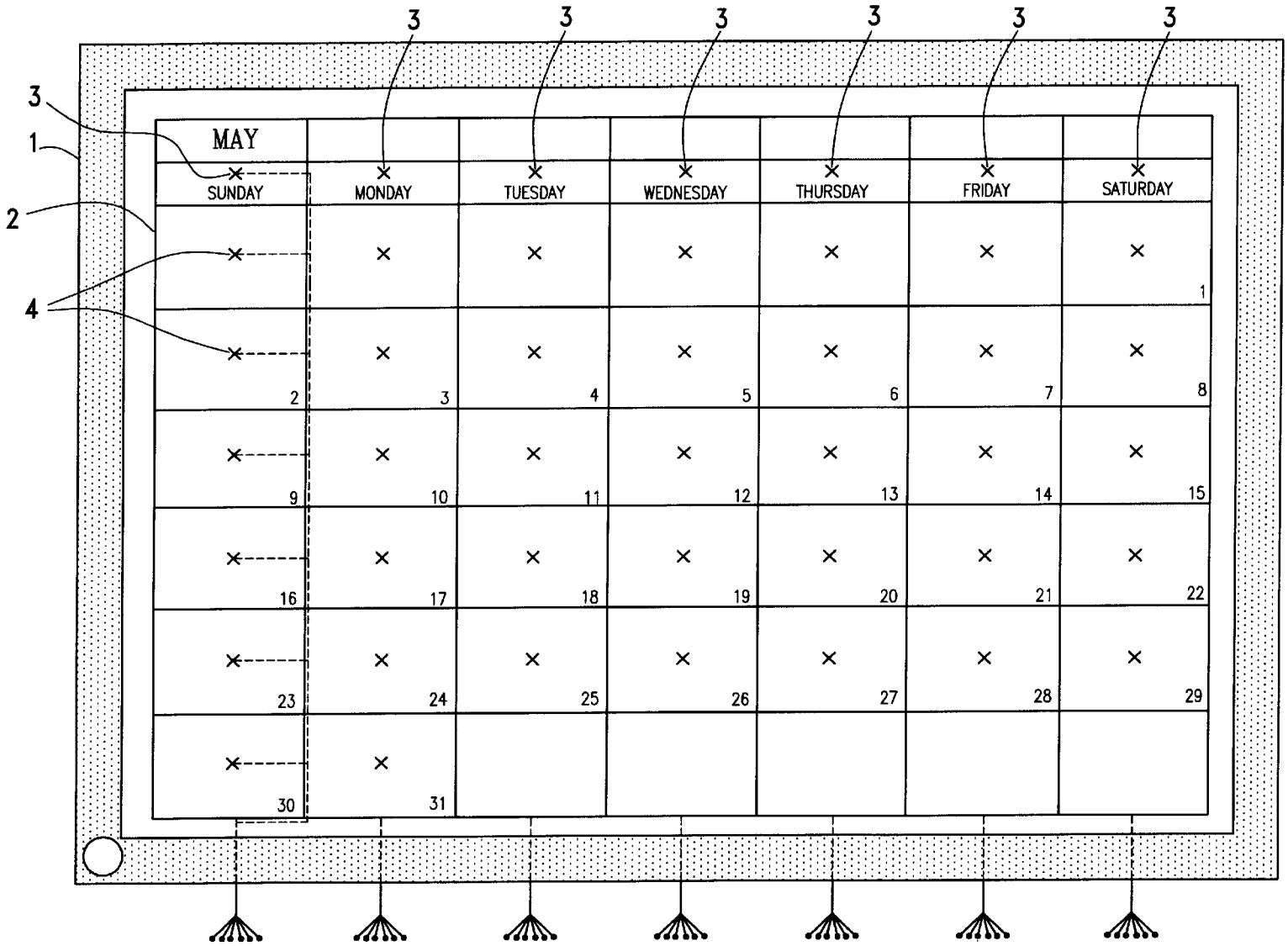
FIG. 2 shows the entire rack with LED's attached superimposed on an ordinary wall calendar.

In reference to FIG. 2, the drawing shows a frame-like rack 1 superimposed on an ordinary calendar 2 with seven LED's 3 of a single color each positioned over a particular day of the week on the calendar, to indicate the current day of the week. Similarly, thirty-seven LED's 4 of a different single color each positioned over a particular space on which a day of the month may occur, to indicate the current day of the month.

Figure 1:
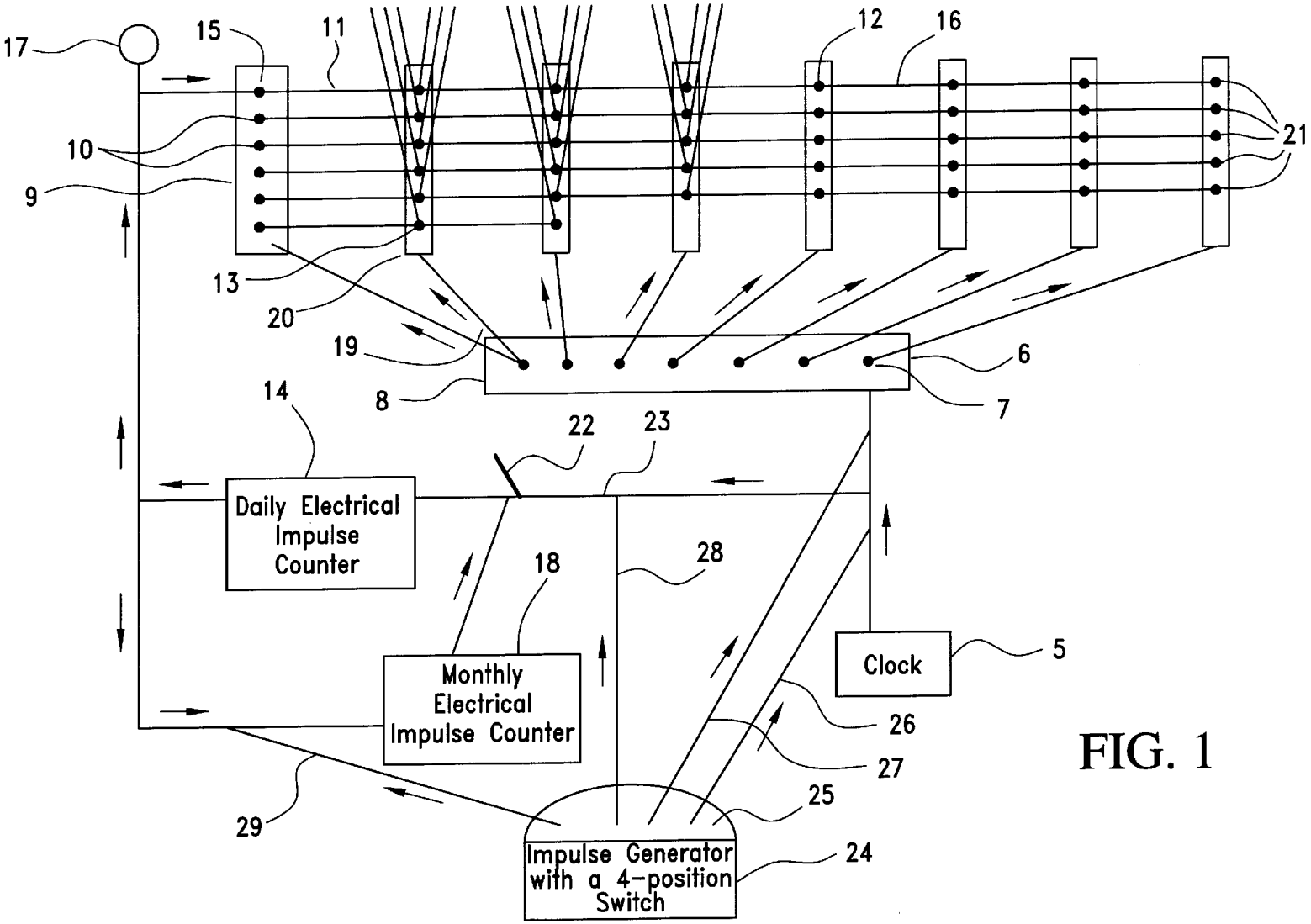
FIG. 1 shows the electrical schematic and associated elements which control the proper lighting of the LED's.

In reference to FIG. 1, the drawing shows a clock 5 that generates an electrical impulse each day, hereafter referred to as "the impulse," that is the basis of the electrical operation of the device.

The drawing shows a cyclical switch with seven-contacts 6 , with each contact 7 aligned with a particular day of the week on the calendar, the left contact 8 on the schematic being Sunday. The cyclical switch is set in actual time for operation.

The drawing shows a six-contact stepping switch 9 with each contact 10 linked to a conductor 11 with seven outlets 12 or two outlets 13 to provide power for energizing the indicating LED's for the calendar week. Each Sunday, the impulse energizes the stepping switch 9 to shift power from the conductor serving the expired week to energize the conductor providing power for illumination in the new calendar week.

The drawing shows an electrical impulse counter 14 that registers each daily impulse of the clock 5. This electrical impulse counter is cyclically programmed to transmit an electrical impulse on the first of each month to open the contact 15 on the six-contact stepping switch 9 that provides power for illumination in the first calendar week 16 of the new month. This impulse also energizes a light 17 on the rack as an alert to remove expired month sheet from the calendar; also, the impulse is registered on a monthly counter 18.

Each day the daily impulse steps the cyclical switch 6, from left to right on the drawing, that opens power on the conductor 19 to trigger a relay 20 that opens the five or six outlets 21 on the power providing conductor, including the energized conductor, which, in turn, energizes the Led indicating the current day of the month and the Led indicating the current day of the week. Said five or six outlets 21 are each linked to the same Led indicating the day of the week and each is linked to a different week of the month to indicate the day of the month.

The Leap Year variation is adjusted by a programmed monthly electrical impulse counter 18 that transmits an electrical impulse on February 28, Leap Year, to close a switch 22 on the line 23 transmitting the daily impulse to be registered on the daily electrical impulse counter 14. The following daily impulse is blocked for one day preventing the daily counter 14 in its routine from transferring the electrical operation to the new month, which allows illumination on February 29.

The drawing in FIG. 1, shows a hand-operated electrical impulse generator 24 with a selector switch 25 with four positions to reset the device. Position one, represented by line 26, resets the entire system. Position two, represented by line 27, resets the lighting system. Position three, represented by line 28, resets the programmed daily electrical impulse counter. Position four, represented by line 29, resets the monthly electrical impulse counter.

It is claimed:

1. An electrical device including an electrical system for automatically indicating the current day of the week and the current day of the month on an ordinary calendar comprising:

a) a rack 1 to be superimposed on an ordinary calendar 2, b) seven light emitting diodes 3 of a single color affixed to the rack to appear over a particular day of the week and to indicate the current day of the week.

c) thirty-seven light emitting diodes 4 of a different single color, each light emitting diode affixed to said rack to appear over a single space on said calendar on which a day of the month may appear to indicate the current day of the month, said calendar including a sheet for each month of the year, an alert light on said rack energized by an electrical impulse to indicate for removal of an expired month sheet.

d) an electrical network of switches 6, 9 and associated elements therewith to energize said electrical system including energizing said light emitting diodes to coordinate with actual time, e) and means to program said device to operate continuously in unlimited time.

* * * * *